US005544891A

United States Patent [19]

Gibson et al.

[11] Patent Number: 5,544,891

[45] Date of Patent: Aug. 13, 1996

[54] EXERCISE AND NUTRITIONAL GAME AND METHOD OF USING SAME

[76] Inventors: Sandra J. Gibson, 333 South East, Apt. 403, Oak Park, Ill. 60302; Marlene Barclay, 5301 Hallford Dr., Dunwoody, Ga. 30338

[21] Appl. No.: 432,769

[22] Filed: May 2, 1995

[51] Int. Cl.[6] ..... A63F 3/00

[52] U.S. Cl. ..... 273/244; 273/431; 273/440

[58] Field of Search ..... 273/243, 244, 273/440, 249, 242, 429–432

[56] References Cited

U.S. PATENT DOCUMENTS

| | | | |
|---|---|---|---|
| 3,722,885 | 3/1973 | Leaf | 273/440 |
| 4,040,628 | 8/1977 | Pope | 273/243 |
| 4,159,117 | 6/1979 | Kuna | 273/243 |
| 4,174,840 | 11/1979 | Curtiss | 273/248 |
| 4,372,559 | 2/1983 | Summers | 273/243 |
| 4,440,396 | 4/1984 | Frudakis | 273/242 |
| 5,062,645 | 11/1991 | Goodman et al. | 273/249 |
| 5,143,373 | 9/1992 | Joel | 273/243 |
| 5,273,431 | 12/1993 | Charouhas | 273/243 |

FOREIGN PATENT DOCUMENTS

| | | | |
|---|---|---|---|
| 2556570 | 6/1977 | Germany | 273/244 |

*Primary Examiner*—Benjamin H. Layno
*Attorney, Agent, or Firm*—Lee, Mann, Smith, McWilliams, Sweeney & Ohlson

[57] ABSTRACT

An exercise and nutritional game apparatus adapted to be played by a plurality of players operating in turn. The game apparatus includes a game board having a playing path defined by a plurality of contiguous spaces; a set of playing pieces; a pair of dice; a chance means for determining an exercise; a first plurality of cards each having printed thereon a nutritional question, a choice of possible answers, and a correct answer; a second plurality of cards each having printed thereon a number to reduce repetitions of a particular exercise; a third plurality of cards having printed thereon a junk food question, a choice of possible answers, and a correct answer; and a booklet with nutritional and junk food supplemental information and exercise descriptions. Play is conducted by advancing the playing piece along the playing path for the number of spaces determined by a throw of the dice. Various colors of the contiguous spaces determines various courses of action for the player which lands on a space. Those courses of actions include selecting an exercise to perform, selecting a nutritional question to answer, selecting a junk food question to answer, and selecting a card to reduce repetitions of an exercise. Weight is symbolically gained when exercises are not fully performed as directed and when nutritional and junk food are answered incorrectly. Weight is symbolically lost when exercises are fully performed and when questions are answered correctly. Weight may be lost or gained by wagering units of weight on whether a player will fully perform a given exercise. The winner of the game is the player that finishes with the least amount of weight gain.

5 Claims, 3 Drawing Sheets

EXERCISE AND NUTRITIONAL GAME AND METHOD OF USING SAME

FIELD OF THE INVENTION

The present invention relates to the field of board games and more particularly to a board game designed for players of the game to improve their health by performing various exercises in playing of the game and by gaining knowledge related to good nutrition during the playing of the game.

BACKGROUND OF THE INVENTION

There are known in the art a variety of board games designed to encourage weight control, dieting, nutrition and exercise. A common theme to most of these games is to encourage weight control and exercise. Although encouragement is good, nothing prevents the game players from disregarding all information and encouragement obtained during the playing and never actually practicing good exercise or nutrition at any time. The present invention has a major advantage of not only encouraging weight control, proper dieting and exercise in playing the game, but makes exercise and gaining nutritional information an actual part of playing the game. This way the participant not only enjoys the friendly competition in playing the game with others, but obtains the healthy advantages of exercise during the actual playing of the game.

SUMMARY OF THE INVENTION

The present invention is a game apparatus and method of play for an exercise and nutritional education game having as a primary objective to provide entertainment, to provide instructions for low to high impact exercises and stretching exercises, and to provide nutritional information in a manner that the concept of fitness takes on a new and exciting dimension, while imparting fundamental information on how to improve personal health.

It is an object of the invention to provide a game wherein the competing players seek to finish the game having symbolically lost more weight or gained less weight than the other competing players.

It is another object of this invention to promote the understanding of how nutritional facts can be applied to everyday living.

It is another object of this invention to promote the importance of safe exercise in the attainment of optimal physical fitness.

It is yet another object of this invention to increase awareness of the uses and sources of vitamins and minerals.

These and other objects are accomplished by a game for promoting exercise and nutrition, having; a plurality of playing pieces for each of one or more players, a plurality of cards having nutritional questions and corresponding answers, a plurality of cards having instructions on reducing exercise repetitions, and a means for making a chance selection of an exercise. The game board has a playing surface with a path to advance said playing pieces. The path has contiguous locations with an identifying characteristic to signal to a player the appropriate action for the player to take after advancing said playing piece to said location. After advancing the playing piece to a location on said path, the player will either take another turn, randomly select an exercise, attempt to answer a nutritional question, pull a card to reduce repetitions, or attempt to answer a junk food question, depending on the identifying characteristic of the resulting location of the playing piece.

BRIEF DESCRIPTION OF THE DRAWINGS

The invention will be more fully understood and appreciated from the following detailed description of a preferred embodiment thereof taken in conjunction with the drawings in which.

DETAILED DESCRIPTION OF THE INVENTION

Figure 1:
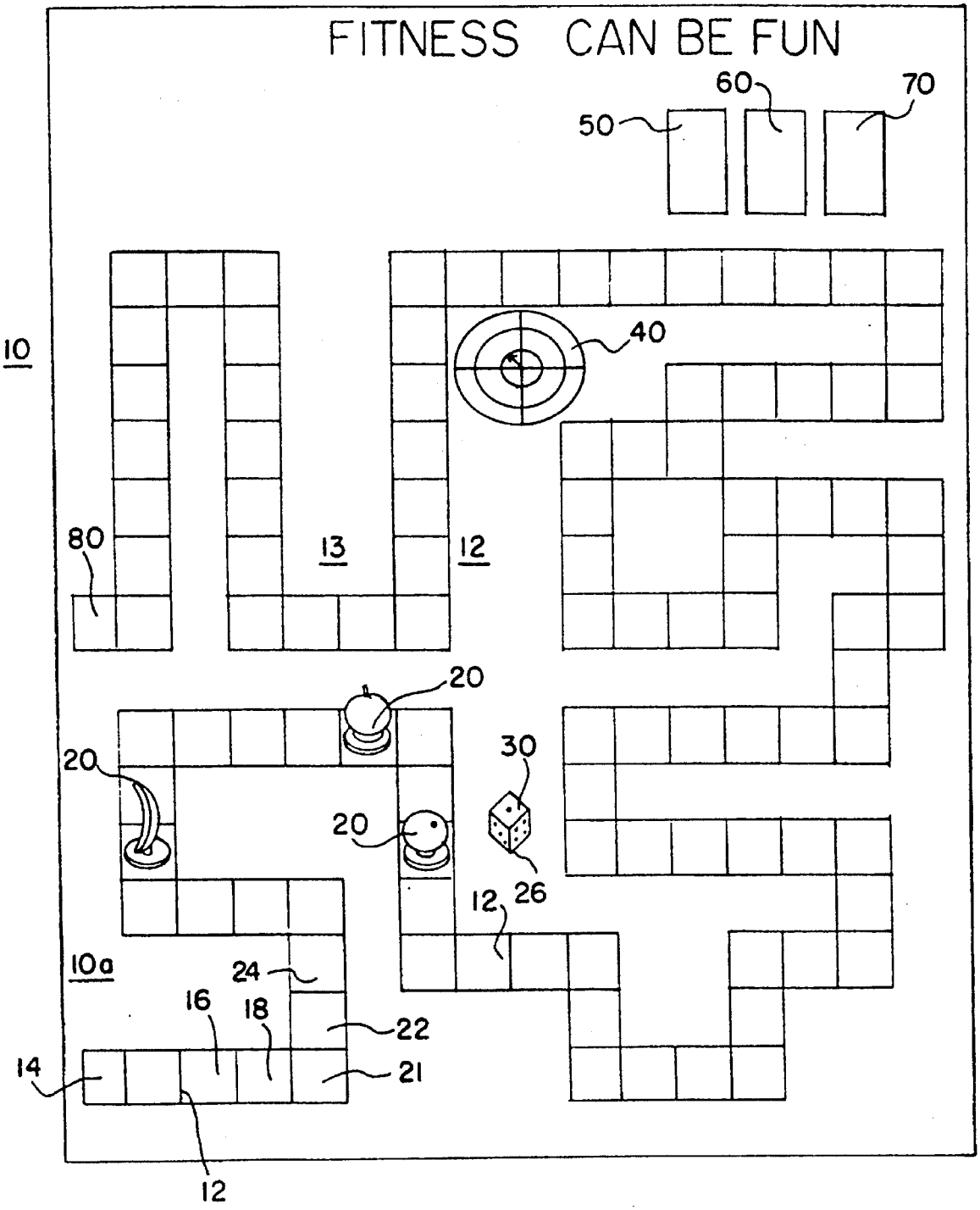
FIG. 1 is a top plan view of the game board apparatus of the present invention showing game pieces, a die, and playing cards set on top the game board.

Referring now to the drawings it is noted that the drawings and the descriptions thereof which follow are merely intended to be exemplary of preferred embodiments of the invention and are not intended to be exhaustive of the possibilities of games or types of games within the intended scope of the invention.

Figure 6A:
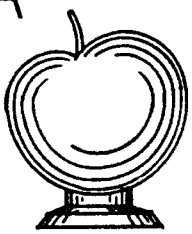
FIG. 6 is a front plan view of a set of playing pieces.
Figure 6B:
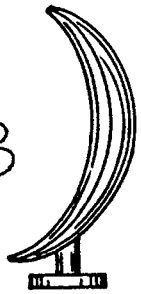
Figure 6C:
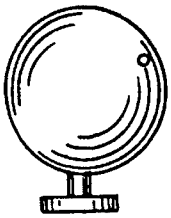

The exercise and nutritional game apparatus of the present invention comprises a game board 10, a set of playing pieces 20 for each player (FIG. 6A, 6B and 6C), chance means 30, chance means for selecting various exercises 40, a plurality of "Nutritional" playing cards 50, a plurality of "Combat" playing cards 60, and a plurality of "Junk Food" playing cards 70. FIG. 1 illustrates the game board 10 having the chance means 30, an exercise wheel 40, "Nutritional" playing cards 50, "Combat" playing cards 60, and "Junk Food" playing cards 70 disposed thereon.

The game board 10 has a plurality of contiguous spaces 12, printed on the upper surface 10*a* of the game board 10 defining a playing path 13. In the preferred embodiment of the game board 10 illustrated in FIG. 1, the plurality of contiguous spaces 12 follow a generally random path between a starting position 14 and an ending position 80. The game board 10 further includes representations of "roll again" spaces 16, "exercise" spaces 18, "Nutritional" spaces 21, "combat" spaces 22, and "city structure" spaces 24 printed thereon which are disposed between selective adjacent contiguous spaces 12. In the preferred embodiment, the type of space can be indicated by color. A blue space indicates a "nutritional" space, a red space indicates an "exercise" space, a black space indicates a "combat" space, and a yellow space indicates a "roll again" space.

Upon starting the game, players role a die 26 (or multiple dies or dice) to determine the order said players play the game. The players turns are determined having the player obtaining the highest number on the role of the die 26 take their turn first. The remaining players take there turns starting in a clockwise direction from the player having the highest roll of the die. In the event of a tie for highest rolled number of the die, the die is re-rolled to determine who starts first between the players that rolled ties. A player's advances along the playing path 13 is determined by the throw of the die 26, with the number of the die 26 throw being the number of spaces a player moves their playing piece 20 along the path 13.

If a player advances his/her playing piece 20 to a "roll again" space 16, the player must roll the die 26 again and advance again according to number rolled on the die 26.

Figure 5:
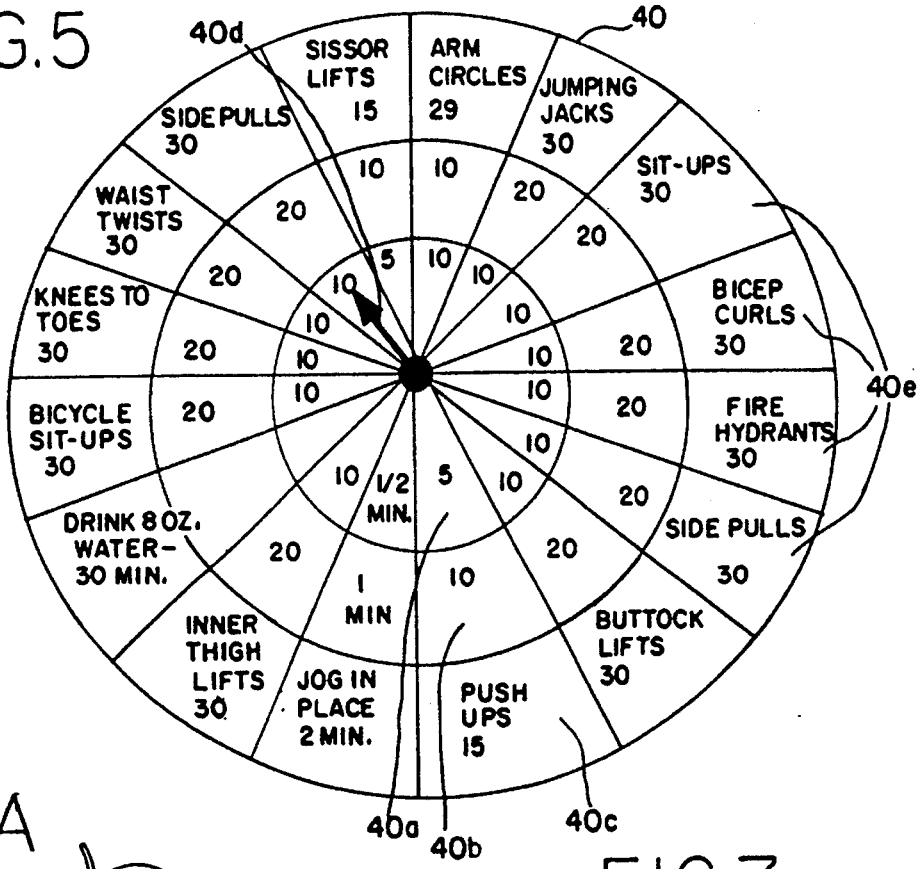
FIG. 5 is a top plan view of the face of an "Exercise" wheel.

If a player advances their playing piece 20 to an exercise space 18, the player must select by chance means an exercise to perform. In the preferred embodiment, the chance means for selecting an exercise is an exercise wheel 40. (As seen in FIG. 5). The exercise wheel 40 is comprised of three concentric circles. The beginners circle 40*a* is the inner most circle in the wheel 40, the intermediate circle 40*b* is the middle circle in the wheel 40, and the advanced circle 40*c* is the outer most circle of the wheel 40. The wheel also is comprised of a number exercise locations 40*e*, with each exercise location 40*e* corresponding with each concentric circle 40*a*, 40*b*, and 40*c*. The number of repetitions of exercises increases from the beginners circle 40*a* to the advanced circle 40*c*. An exercise arm 40*d* pivotally attached to the center of the wheel 40 is spun to determine which exercise a player must perform. Prior to starting the game, each player can determine which particular concentric circle on the wheel 40 that particular player will use. As seen in FIG. 5, the exercise arm 40*d* is pointing to the "side pulls" exercise location on the exercise wheel 40. Therefore, if a player spins the exercise wheel 40 and it stops on the "side pulls" exercise location on the wheel 40, that player would have to perform either, thirty, twenty, or ten repetitions of the "side pulls" exercise depending on which concentric circle the player chose to use at the start of the game. If the player cannot perform an entire exercise, the player symbolically gains five pounds. If the player performs an entire exercise, the player symbolically loses five pounds. Each player can further reduce his/her weight by another five (5) pounds by doubling the indicated exercise to perform. Players may also wager five (5) pound side bets with the player presently tacking a turn, by chancing that the particular player can not perform the number of exercises required. For example, if a player makes a side bet with another player that the player taking a turn can not fully perform a selected exercise, and the player taking the turn does successfully perform the selected exercise, then the player betting that the exercise could not be successfully performed by the player taking the turn would gain five (5) pounds, and the player betting the exercise could be performed would lose (5) pounds.

If a player advances his/her playing piece 20 to a combat space 22, the player must select a combat card 60 from the top of a deck of combat cards 60. Each combat card 60 has printed thereon the number of times a player may reduce repetitions of a particular exercise. Players use the combat cards 60 to reduce repetitions of particular exercises. Players can collect a maximum of five (5) combat cards 60 during the course of the game. If a player already has five (5) combat cards 60 and lands on a combat space 22, that player must wait until their next turn to proceed playing the game. Players have the option of trading combat cards 60.

Figure 2:
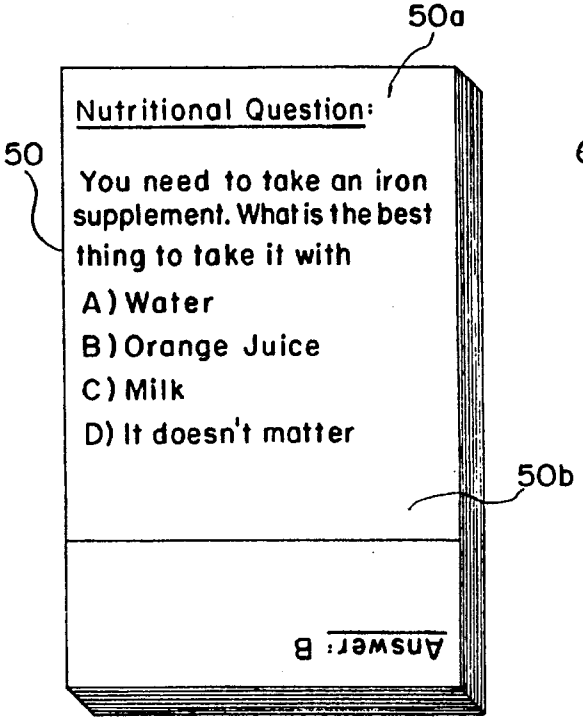
FIG. 2 is a perspective view of a deck of "Nutritional" playing cards showing an example nutritional question and answer on the top card.
Figure 3:
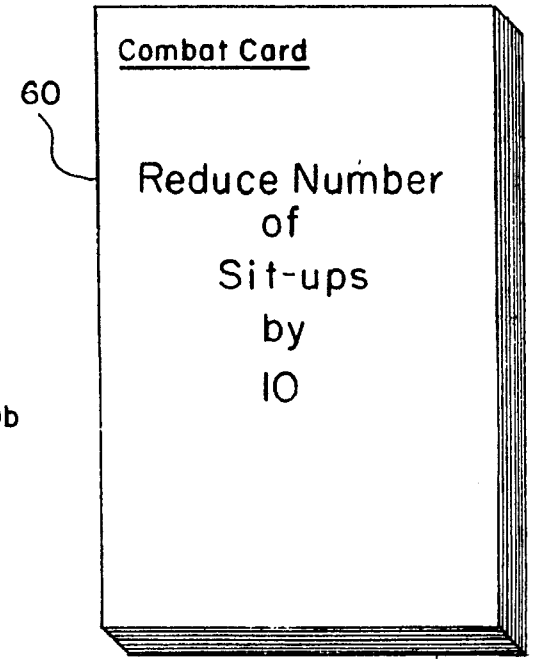
FIG. 3 is a perspective view of a deck of "Combat" playing cards showing an example combat card exercise instruction on the top card.

If a player advances his/her playing piece 20 to a nutritional space 21, an opposing player selects a nutritional card 50 having printed thereon a nutritional question 50*a* and a corresponding nutritional answer 50*b* from a deck of nutritional cards 50 (As seen in FIG. 2). An opposing player asks the player who advanced to the nutritional space 21 the nutritional question 50*a* printed on the card 50. If the player answers the nutritional question 50*a* correctly, the player loses five pounds. If the player answers the nutritional question 50*a* incorrectly, the player gains five pounds.

Figure 4:
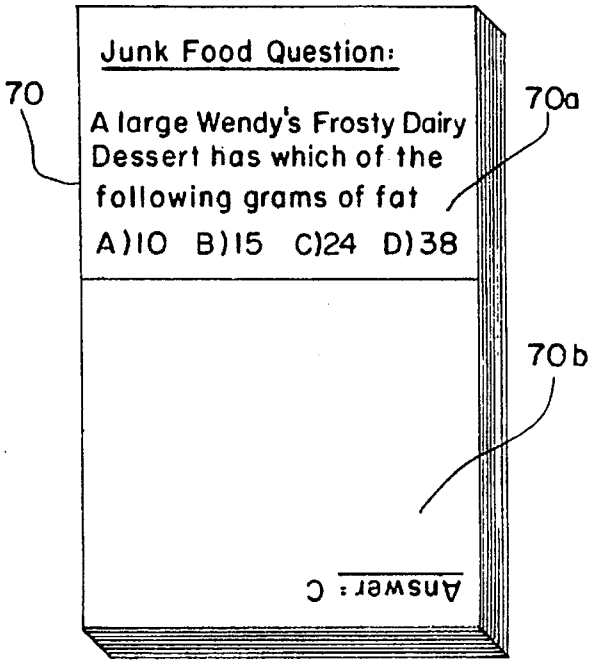
FIG. 4 is a perspective view of a deck of "Junk Food" playing cards showing an example junk food question and answer on the top card.

If a player advances his/her playing piece 20 to a city structure space 24, an opposing player selects a junk food card 70 having printed thereon a junk food question 70*a* and a corresponding junk food answer 70*b* from the top of a deck of junk food cards 70 (As seen in FIG. 4). An opposing player asks the player who advanced to the city structure space 24 the junk food question 70*a* printed on the card 70. If the player answers the junk food question 70*a* correctly, the player loses five pounds. If the player answers the junk food question 7*a* incorrectly, the player gains five pounds.

Figure 7:
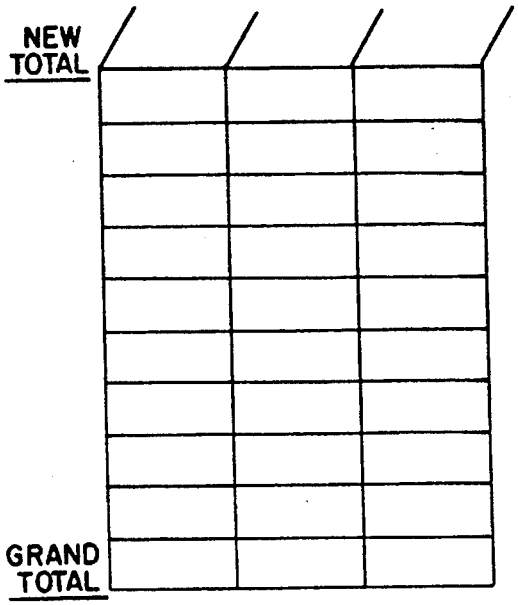
FIG. 7 is a top plan view of the score sheet.

After all the players have advanced to ending position 80, the player having the greatest weight loss or, if no player has lost weight, the least weight gain, is the winner of the game. Scores are determined by adding and subtracting the weights gained and lost throughout the game on individual game score sheets 82. (As seen in FIG. 7).

It should be understood that the present invention is not limited to the exact devices and instrumentalities described herein. Additional embodiments of the present inventive concept will now be apparent to those skilled in the art. Accordingly, reference should be made to the appended claims rather than the foregoing Specification as defining the true scope of the subject invention.

What is claimed is:

1. A method of playing an exercise and nutritional game comprising the steps of:

providing a game board having a plurality of contiguous spaces, including exercise spaces, nutritional question spaces, exercise reduction spaces, and city structure spaces;

providing a plurality of playing pieces;

providing a plurality of combat cards.

2. A method of claim 1, wherein the method of determining by chance the number of spaces to advance said playing piece on the game board is made by a throw of a die.

3. A method of claim 1, wherein the method of determining by chance an exercise is made by spinning a wheel.

4. A method of claim 1, wherein the method of determining by chance an exercise is made by a selecting a card.

5. A method of claim 1, wherein the method of determining by chance a nutritional question is made by selecting a card.

* * * * *